US006168457B1

(12) United States Patent
Kim

(10) Patent No.: US 6,168,457 B1
(45) Date of Patent: Jan. 2, 2001

(54) ELECTRIC WIRE CONNECTING STRUCTURE

(75) Inventor: Yoengseog Kim, Kyungki-do (KR)

(73) Assignee: Hyundai Motor Company, Seoul (KR)

( * ) Notice: Under 35 U.S.C. 154(b), the term of this patent shall be extended for 0 days.

(21) Appl. No.: 08/950,753

(22) Filed: Oct. 15, 1997

(30) Foreign Application Priority Data

Oct. 15, 1996 (KR) ..... 96-45971

(51) Int. Cl.[7] ..... H01R 4/24
(52) U.S. Cl. ..... 439/406; 439/426
(58) Field of Search ..... 439/393, 425, 439/426, 391, 418, 421, 406

(56) References Cited

U.S. PATENT DOCUMENTS 2,291,434 * 7/1942 Hollopeter et al. ..... 439/393
2,534,881 * 12/1950 Schroeder ..... 439/425
2,749,383 * 6/1956 Pigman et al. ..... 439/421
3,242,256 * 3/1966 Jugle ..... 439/425
3,760,331 * 9/1973 Gurley ..... 439/391
4,033,661 * 7/1977 Moody et al. ..... 439/406
4,508,409 * 4/1985 Cherry et al. ..... 439/391
5,019,674 * 5/1991 Greene ..... 439/426
5,759,065 * 6/1998 Hatagishi et al. ..... 439/417

FOREIGN PATENT DOCUMENTS

2702092 * 9/1994 (FR) ..... 439/406

* cited by examiner

*Primary Examiner*—Paula Bradley
*Assistant Examiner*—Tho Dac Ta

(57) ABSTRACT

A electric wire connecting structure including a first wire connector which taps into electric current flowing through a first electric wire, a second wire connector connected to a second wire, and a bridge integrally connecting the first wire connector and the second wire connector, such that electric current is transmitted from the first wire to the second wire.

12 Claims, 5 Drawing Sheets

ELECTRIC WIRE CONNECTING STRUCTURE

FIELD OF THE INVENTION

The present invention relates to an electric wire connecting structure, and more particularly, to an electric wire connecting structure which allows for easy connection of one wire to another.

BACKGROUND OF THE INVENTION

Generally, electrical wires are used to supply an electric current from a power supply to electrical and electronic devices. When connecting one electric wire to another electric wire, a section of an insulating cover on a main electric wire is removed and a section of an insulating cover on an end of an attaching wire is removed. The exposed portions of the two wires are then attached and fixed by soldering. After soldering is completed, the soldered exposed portions are taped using insulating tape or insulated by using a thermally contracting tube made of an insulating material.

However, in the above prior art method of connecting electrical wires, the removing of the insulating cover from the wires, soldering the exposed portions, then re-insulating the wires is a complicated and time-consuming process.

SUMMARY OF THE INVENTION

The present invention has been made in an effort to solve the above problems.

It is an object of the present invention to provide an electrical wire connecting structure for allowing easy connection of one electrical wire to another.

To achieve the above object, the present invention provides an electrical wire connecting structure comprising a first wire connector which taps into electrical current flowing through a first electric wire, a second wire connector which penetrates through to the conductive core of the second electrical wire, and a bridge integrally connecting the first wire connector and the second wire connector, such that electric current is transmitted from the first wire to the second wire.

Further, each of the first and second wire connectors is provided with a plurality of spikes formed along the inside circumference thereof for penetrating through the insulating covers of the first and second wires.

The first wire connector and the second wire connector are made of elastic material having plastic characteristics and are substantially cylindrical and contain piercing tabs.

The outer circumferences of the first wire connector and the second wire connector are coated with insulating material.

In another aspect, the pierce tabs are formed along the inside circumferences of the main wire connector and the attaching wire connector facing the first and second electrical wires for penetrating through insulating covers and contacting the conductive cores of the first and second electrical wires, respectively.

Each of the first and second wire connectors is made of a plastic material having plastic characteristics and is substantially cylindrical in shape with a gap formed along the length thereof.

Further, the present invention provides an electrical wire connecting structure which is a conductive assembly. Comprising a first cylindrical wire connector which is to be disposed around the first electrical wire when connecting the first electrical wire to the second electrical wire, the first cylindrical wire connector having a tapping portion which taps into electrical current flowing through the conductive core of the first electric wire, a second cylindrical wire connector which is to be disposed around the second electrical wire, the second cylindrical wire connector having a penetrating portion that penetrates through insulation to the conductive core of the second electrical wire, and a bridge integrally connecting the first wire connector and the second wire connector, such that electrical current is transmitted from the first electrical wire to the second electrical wire. An insulating member covers at least a portion of the conductive assembly which is exposed to the outside.

Each of the tapping portion and penetrating portion includes a plurality of spikes formed along the inside circumference of the first and second cylindrical wire connectors for penetrating through the insulating covers of the first and second wires and contacting the conductive cores when the first and second cylindrical wire connectors are disposed around the first and second electrical wires, respectively.

The first cylindrical wire connector and the second cylindrical wire connector are made of a material having plastic characteristics.

Each of the tapping portion and penetrating portion is comprised of a piercing tap formed by cutting a portion of each of the first and second cylindrical wire connectors.

The first and second wire connectors are made of a material having plastic characteristics.

Each of the first and second wire connectors is provided with a slot or gap which allows the wire connectors to be widened in the radial direction so as to provide convenience when placing the connectors on the wires.

BRIEF DESCRIPTION OF THE DRAWINGS

The accompanying drawings, which are incorporated in and constitute a part of the specification, illustrate an embodiment of the present invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
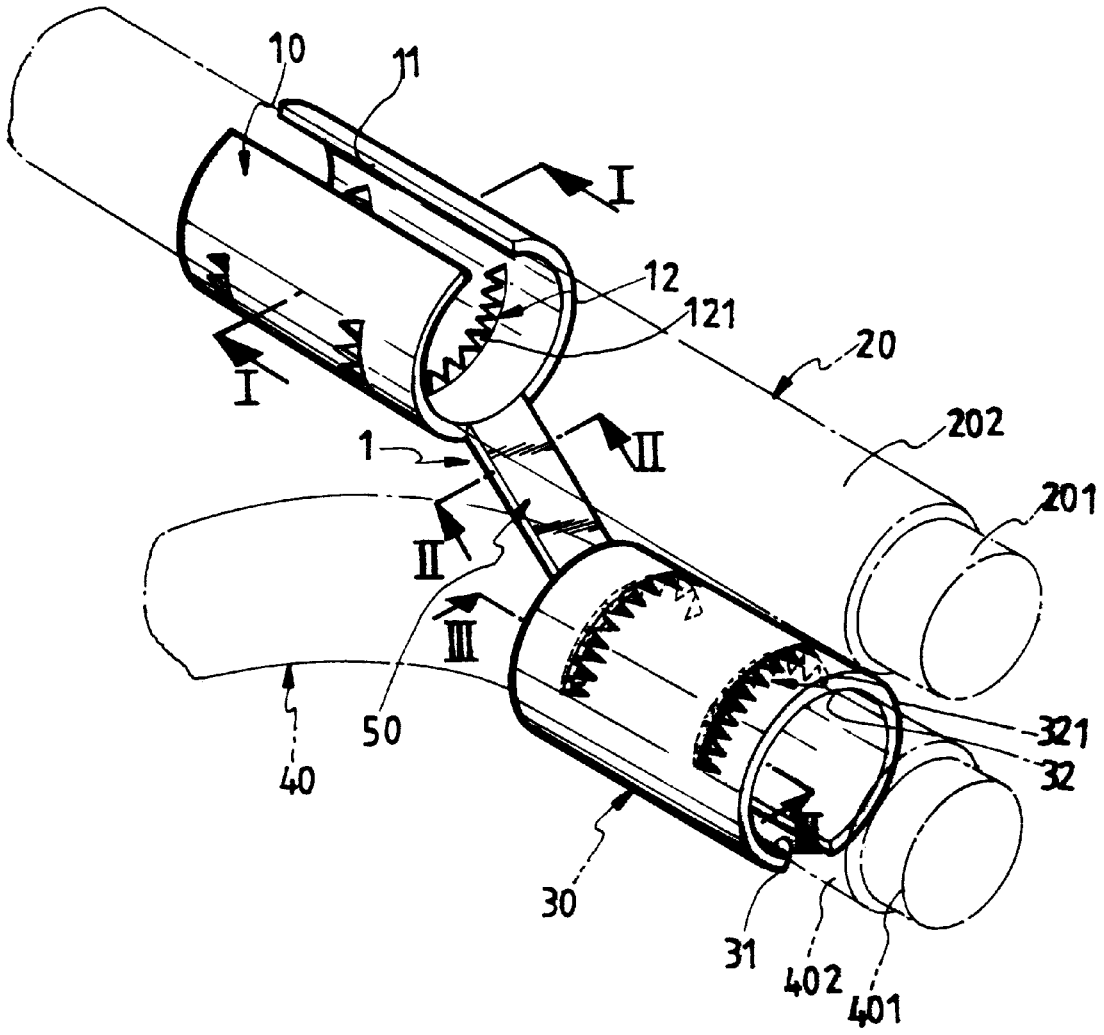
FIG. 1 is a perspective view illustrating an electrical wire connecting structure according to a first embodiment of the present invention.

Referring to FIG. 1, shown is a perspective view of an electric wire connecting structure according to a first embodiment of the present invention.

As shown in the drawing, the inventive electric wire connecting structure 1 is used to electrically connect a first wire 20, having a first conductive core 201 and a first insulating cover 202 covering the first conductive core 201, to a second wire 40, having a second conductive core 401 and a second insulating cover 402 covering the second conductive core 401.

The electric wire connecting structure 1 comprises a first wire connector 10 fixedly disposed around the first electric wire 20 such that it taps into the electric current flowing through the first electric wire 20, a second wire connector 30 fixedly disposed around the second electric wire 40 and electrically connected to the second wire 40, and a bridge 50 connecting the first and second wire connectors 10 and 30. Each of the wire connectors 10 and 30 is made of a material having plastic characters and is substantially cylindrical. Gaps 11 and 31 are formed along the length of the connectors 10 and 30, respectively.

Formed along the inside circumferences of the first and second wire connectors 10 and 30 are electric contacting members 12 and 32, respectively. The electric contacting members 12 and 32 extend towards the first and second wires 20 and 40 such that they penetrate through insulating covers 202 and 402 to contact the first and second conductive cores 201 and 401, respectively.

Figure 2A:
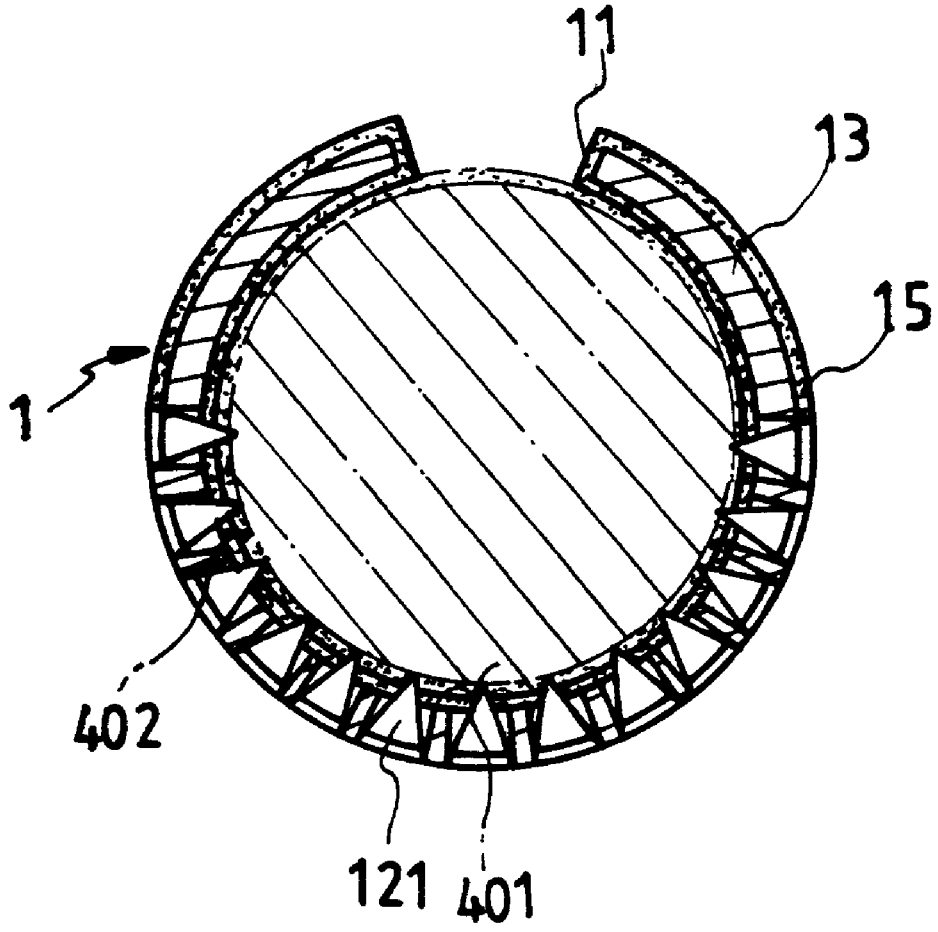
FIGS. 2A, 2B and 2C are sectional views taken along lines I—I, II—II, and III—III of FIG. 1, respectively.
Figure 2B:
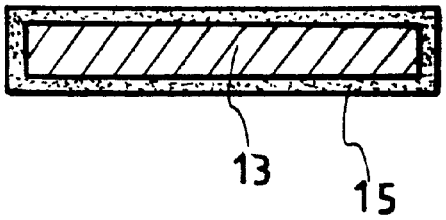
Figure 2C:
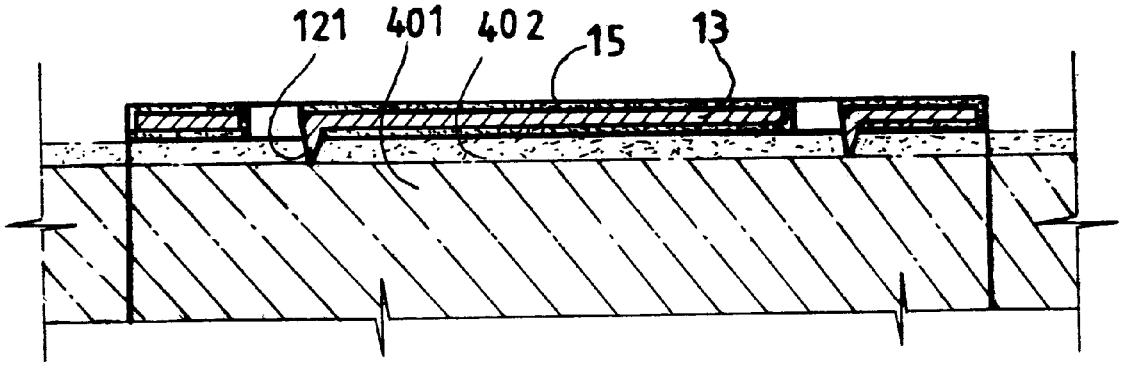

Referring to FIGS. 2A, 2B and 2C, there are shown sectional views taken along lines I—I, II—II, and III—III of FIG. 1, respectively. The drawings illustrate the electric wire connector 1 more in detail.

As shown in the drawings, the electric wire connector 1 comprises a main wire connector body 13 and an insulator 15 coated on the main wire connector body 13 except at locations where the electric contacting members 12 and 32 are provided.

In this embodiment, although the main wire connector body 13 is coated with the insulator 15, the present invention is not limited to this structure. That is, only exposed portions to the outer side may be coated with insulating material or covered with insulating tape.

Preferably, each of the electric contacting members 12 and 32 is composed of a plurality of spikes 121 and 321 formed by pieces that are partially cut from the main wire connector body 13 and bent toward the wire 20 as shown in FIG. 2A. However, the present invention is not limited to this structure. That is, the spikes 121 and 321 may be integrally formed on the inner surfaces of the connectors 10 and 30.

Accordingly, when a user inserts the first wire 20 into the first wire connector 10 in a state where the gap 11 of the first wire connector 10 is widened, compresses the first wire connector 10 is compressed on the first wire 20. Similarly the second wire connector 30 is disposed on the second wire to. The spikes 121 and 321 of the respective electric contacting members 12 and 32 respectively penetrate the insulating covers 202 and 402 of the wires 20 and 40 such that they contact the first and second conductive cores 201 and 401, respectively. As a result, electrical current is transmitted from the first electric wire 20 to the second electric wire 40.

Figure 3:
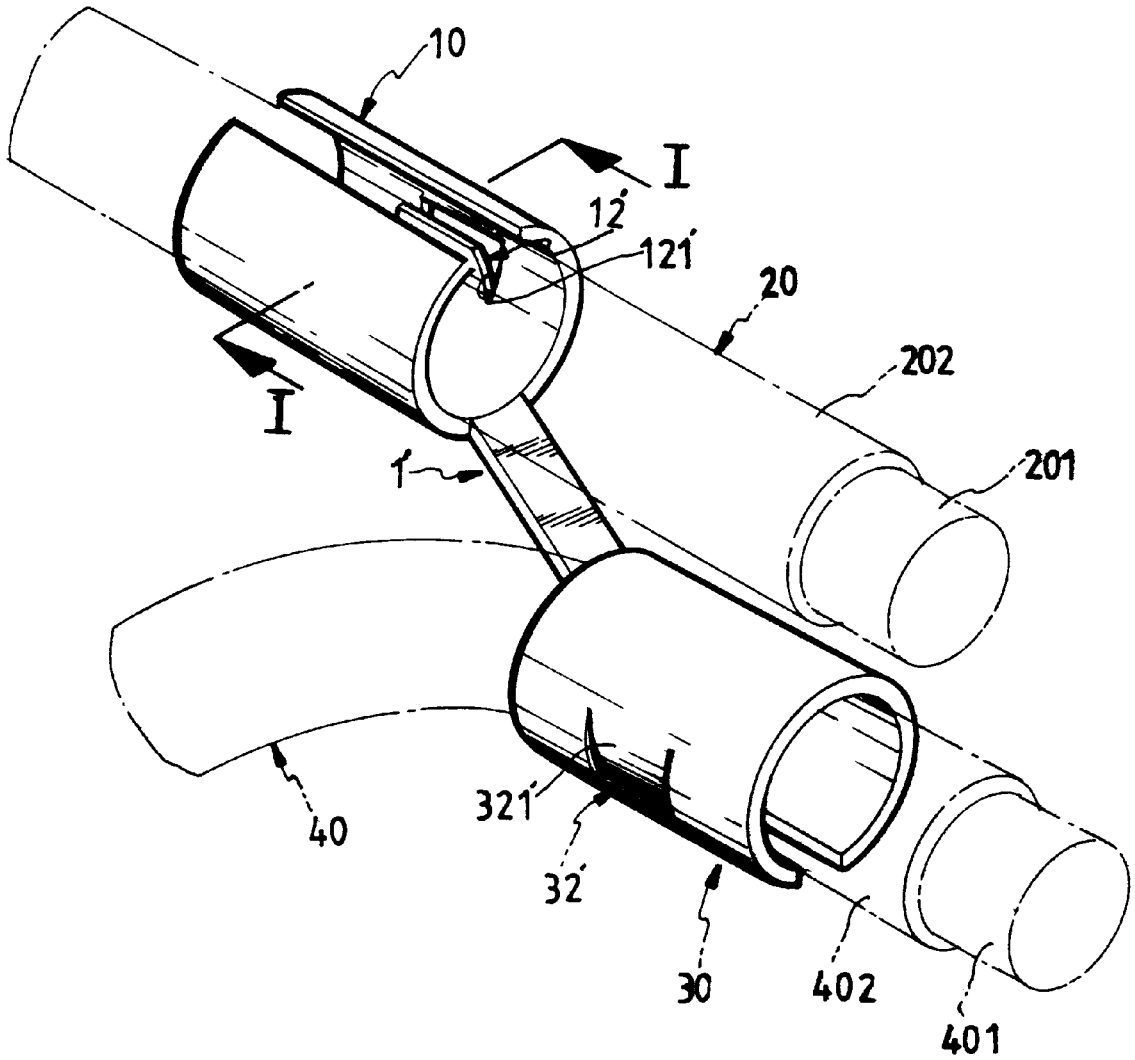
FIG. 3 is a perspective view illustrating an electrical wire connecting structure according to a second embodiment of the present invention.

Referring to FIG. 3, there is shown a perspective view of an electric wire connecting structure according to a second embodiment of the present invention. The wire connecting structure 1' according to the second embodiment is substantially identical to that of the first embodiment except for the structure of the electric contacting members 12 and 32.

That is, while each of the electric contacting members 12 and 32 is comprised of a plurality of spikes 121 and 321 in the first embodiment, in the second embodiment, the electric contacting members 12' and 32' contain piercing tabs 121' and 321', respectively. Each of the tabs is defined by a piece which is formed by cutting three sides of the connectors 10 and 30 and bending them toward the wires 20 and 40, respectively.

Figure 4:
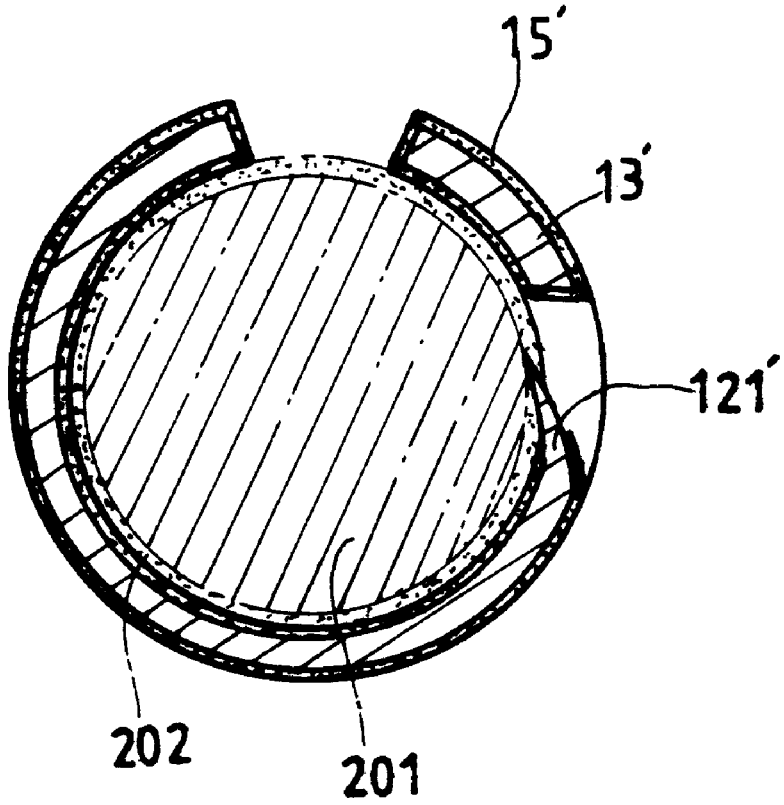
FIG. 4 is a sectional view taken along line I—I of FIG. 3.

Referring to FIG. 4, the wire connecting structure 1' according to the second embodiment comprises a main wire connector body 13' and an insulator 15' coated on the main wire connector body 13' except in areas where the electric contacting members 12' and 32' are provided. The proximal end of each of the piercing tabs 121' and 321' is formed to be sharp such that it can easily penetrate the respective insulating covers 202 and 402 of the wires 20 and 40, respectively. As described above, to permit electrical contact, the electric contacting members 12' and 32' are not coated with the insulator 15'.

Positioning of the electric wire connecting structure 1' is realized by the user placing and compressing the first wire connector 10 on the first wire 20 and the second wire connector 30 on the second wire 40. Next, to tap into the wires 20 and 40, the piercing tabs 121' and 321' are firmly pressed by the user such that they penetrate the insulating covers 202 and 402 of the wires 20 and 40, respectively, thereby making electrical contact with the first and second conductive cores 202 and 402. As a result, electrical current is transmitted from the first electric wire 20 to the second electric wire 40.

With the above electrical wire connecting structure according to the present invention, since the user simply connects the first and second electrical wires without the need to remove insulating material and without the need to solder the two wires together, the connection of one wire to another is easily made.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A structure for connecting first and second electrical wires together, each having a conductive core and an insulating cover covering the conductive core, comprising:

a first wire connector which taps into electrical current flowing through the conductive core of the first electrical wire by receiving the first electrical wire coaxially therein;

a second wire connector which taps into electrical current flowing through the conductive core of the second electrical wire by receiving the second electrical wire coaxially therein; and a bridge integrally connecting the first wire connector and the second wire connector, such that the electrical current is transmitted from the first electrical wire to the second electrical wire, said bridge being positioned to enable the first and second wire connectors to provide adjacent connections between said first and second electrical wires.

2. The structure of claim 1, wherein each of the first and second wire connectors substantially conform to the shape of the first and second electrical wires and comprises a plurality of spikes formed along the inside of said first and second wire connectors for penetrating through the insulating covers of the first and second wires to make electrical contact with the conductive cores.

3. The structure of claim 1, wherein outer surfaces of the first wire connector, the second wire connector, and the bridge are coated with an insulating material.

4. The structure of claim 1, wherein piercing tabs are formed along the inside of the first wire connector and the second wire connector facing the first and second electrical wires for penetrating through the insulating covers and contacting the conductive cores of the first and second electrical wires, respectively.

5. The structure of claim 1, wherein the first and second electronic wires to be connected together are disposed in lateral juxtaposition relative to each other and the first and second wire connectors are electrically connected to the corresponding electrical wires, with said bridge being attached to said first and second wire connectors to accommodate the electrical connection of the first and second electrical wires.

6. The structure of claim 1, wherein the first wire connector and the second wire connector are made of a material having plastic characteristics and have a substantially cylindrical configuration.

7. The structure of claim 6, wherein the cylindrical first and second wire connectors have peripheral gaps formed along the longitudinal length thereof.

8. A structure for connecting first and second electrical wires together, each having a conductive core and an insulating cover covering the conductive core, said structure including a conductive assembly comprising:

a first cylindrical wire connector which is to be disposed around the first electrical wire when connecting the first electrical wire to the second electrical wire, the first cylindrical wire connector having a penetrating portion which penetrates through the insulating cover to the conductive core of the first electrical wire;

a second cylindrical wire connector which is to be disposed around the second electrical wire when connecting the first and second electrical wires to each other, the second cylindrical wire connector having a penetrating portion which penetrates through the insulating cover to the conductive core of the second electrical wire;

a bridge integrally connecting the first wire connector and the second wire connector together and positioned to enable the first and second wire connectors to provide adjacent connections between said first and second electrical wires, whereby electrical current is transmitted from the first electrical wire to the second electrical wire; and an insulating member covering at least a portion of the conductive assembly which is exposed to an environment.

9. The structure of claim 8, wherein the penetrating portions are comprised of a plurality of spikes formed along the inside circumference of the first and second cylindrical wire connectors for penetrating through the insulating covers of the first and second wires and contacting the conductive cores when the first and second cylindrical wire connectors are disposed around the respective first and second electrical wires.

10. The structure of claim 8, wherein the first cylindrical wire connector and the second cylindrical wire connector are made of a material having plastic characteristics.

11. The structure of claim 8, wherein each of the penetrating portions is comprised of a piercing tap formed by cutting a portion of each of the first and second cylindrical wire connectors.

12. The structure of claim 8, wherein each of the first and second wire connectors is provided with a circumferential gap which extends along the longitudinal length of the wire connectors which allows the wire connectors to be widened in a radial direction so as to provide convenience when placing the connectors on the wires.

* * * * *